US007238214B2

(12) United States Patent
Barbour et al.

(10) Patent No.: US 7,238,214 B2
(45) Date of Patent: Jul. 3, 2007

(54) FUEL COMPOSITION

(75) Inventors: Robert Howie Barbour, Ashbourne (GB); David John Rickeard, East Hagbourne (GB); Douglas James Abbott, Kendal (GB)

(73) Assignee: ExxonMobil Research and Engineering Company, Annandale, NJ (US)

( * ) Notice: Subject to any disclaimer, the term of this patent is extended or adjusted under 35 U.S.C. 154(b) by 322 days.

(21) Appl. No.: 10/148,813

(22) PCT Filed: Dec. 14, 2000

(86) PCT No.: PCT/EP00/12754

§ 371 (c)(1),
(2), (4) Date: Oct. 29, 2002

(87) PCT Pub. No.: WO01/44410

PCT Pub. Date: Jun. 21, 2001

(65) Prior Publication Data

US 2005/0028432 A1 Feb. 10, 2005

(30) Foreign Application Priority Data

Dec. 16, 1999 (GB) ..... 9929806.9

(51) Int. Cl.
*C10L 1/00* (2006.01)

(52) U.S. Cl. ..... 44/300; 585/14; 208/14; 208/15; 208/16; 208/17

(58) Field of Classification Search ..... 44/300; 585/14; 208/14, 15, 16, 17
See application file for complete search history.

(56) References Cited

U.S. PATENT DOCUMENTS 5,059,303 A * 10/1991 Taylor et al. ..... 208/96
5,807,413 A * 9/1998 Wittenbrink et al. ..... 44/451

FOREIGN PATENT DOCUMENTS

| | | | |
|---|---|---|---|
| EP | 757092 | * | 2/1997 |
| WO | WO9714769 | * | 4/1997 |
| WO | WO9957232 | * | 11/1999 |

* cited by examiner

*Primary Examiner*—Cephia D. Toomer
(74) *Attorney, Agent, or Firm*—Joseph J. Allocca

(57) ABSTRACT

This invention relates to a diesel fuel composition having enhanced lubricity, said composition comprising a major amount of a diesel fuel as base fuel blended with a minor amount of a nitrogen rich fraction characterised in that the nitrogen rich fraction is derived from a source material selected from (i) a solvent extract of a solid or semi-solid natural fossil, or, (ii) a refinery process stream or blend, the sulphur to nitrogen atom ratio in the nitrogen rich fraction being less than 4. The nitrogen rich fraction has an absolute nitrogen content of at least 1000 ppm by weight and this fraction is (re)blended with the base fuel is no more than 1% by weight of the total fuel composition. Methods of separating, recovering and reblending such naturally occurring nitrogen compounds can be installed or retrofitted at existing refinery and crude oil processing facilities without any substantial increase in production costs.

9 Claims, No Drawings

FUEL COMPOSITION

This invention relates to fuel compositions of low sulphur content which contain at least one component capable of enhancing the lubricity of such low sulphur fuels.

Fuels such as diesel are widely used in automotive transport due to their low cost. However, one of the problems with such fuels is the presence of relatively high concentrations of sulphur compounds. Excessive sulphur contributes to exhaust particulate emissions and can also degrade the effectiveness of some exhaust after-treatment technology which is being introduced in response to regulated limits on exhaust emissions. As a result, the permitted level of sulphur in diesel fuel has been progressively reduced over the years and further reductions are planned for the future. Whilst a reduction in sulphur content can be readily achieved by well known processes such as hydrodesulphurisation which is generally carried out in the presence of a catalyst, such process also adversely affect the lubricity of the resultant desulphurised product. Consequently, it is necessary to formulate compositions which are low in sulphur content but are also of the desired lubricity in order to minimise wear and friction when used in automotive engines and to minimise the damage to the injection system of a diesel engine. It has hitherto been the practice to add anti-wear agents to such formulations including fatty acid, fatty acid esters, lactones, polyoxyalkylene ethers, amino compounds and the like for this purpose. However, compositions containing compounds such as esters are expensive in terms of both material costs and the cost of additive storage facilities.

A publication by Wei and Spikes entitled 'The lubricity of diesel fuels' (published in Wear, 111 (1986) 217) discloses that heterocyclic nitrogen compounds, like quinoline and indole, also have a beneficial effect on the antiwear performance of base fuels. Although these compounds do not have a surfactant like structure they are of the same general structure as the natural compounds that are destroyed during hydrotreatment.

A further article by D. Wei et al in Lubrication Science, 1989, 2(1), pp 63-67 entitled "The Influence of Chemical Structure of Certain Nitrogen-Containing Organic Compounds on Their Antiwear Effectiveness: The Critical Role of Hydroxy Group" shows that the presence of hydroxy groups in some nitrogen-containing compounds improve their antiwear performance significantly. The article concludes that hydroxy substituted benzothiazoles are most effective in wear reduction and anti-scuffing. With this in view the author reports the results of the tests carried out on films formed on rubbing surfaces by the benzo-derivatives of pyridine and thiazole, with or without hydroxy groups on the rings. The article concludes that protective films formed on rubbing surfaces by the above heterocyclic compounds bearing a hydroxy group are significantly different from those produced by their analogues with similar chemical composition and physical properties.

It has also been found that some polycyclic aromatic compounds such as eg carbazoles have limited solubility in the fuel to function efficiently (Wei et al, Journal of Petroleum (Petroleum Processing) Vol 4, No 1, p90, March 1988). Work conducted by Tonen (Japanese patent application No. 7-194502) included alkyl carbazoles, e.g. methyl and ethyl carbazole, where the alkyl group was attached to the heteroatom itself.

JP-A-100176175 relates to a method of imparting excellent lubricating and water-separating properties to a low sulphur (≦0.2 wt %) diesel fuel by adding thereto a specific nitrogen compound (eg n-hexylamine) alone or together with a lubricity improving fatty acid ester.

In each of these instances, the lubricity enhancing component generally has to be synthesised separately and introduced into the fuel from an external additive. This is not only wasteful of resources but also causes proliferation of chemicals into this industry. Moreover, extensive testing is needed to ensure that such externally sourced additives do not have any undesirable side-effects.

Other references such as JP-A-100008070 relate to a base material for improving the lubricity of gas oils (≦0.05 wt % S) suitable for use in diesel engines, the base material being a catalytic or thermally cracked light oil containing ≧4 wt % of a tri- or poly-cyclic aromatic hydrocarbon and ≧15 ppm by mass of basic nitrogen. The base material is used in an amount of 2-15 wt % of the gas oil. There is no mention of the sulphur to nitrogen atom ratio in the base material used in the gas oil.

Similarly, JP-A-080259966 relates to a diesel oil composition which is prepared by (a) subjecting a mixture of 80-97.5 vol % of a direct distillation light oil (LGO) and 2.5-20 vol % of a light oil (LGO?) to a deep desulphurisation step to form a desulphurised oil material (FDGO) and (b) blending the FDGO with up to 8 vol % of a light cracking oil (LCO). The resultant composition is said to have a sulphur content of tip to 500 ppm, a nitrogen content of up to 60 ppm and a polycyclic aromatic content of 3.5-6.0 vol %. The source of nitrogen in these compositions is not clear. There is no mention of the sulphur to nitrogen atom ratio in the fractions blended.

It has now been found that the lubricity of fuels can be enhanced without excessive recourse to additives from an external source but by using components already present in specific fractions of oils and fossil fuels from a natural source which have a relatively low sulphur to nitrogen atom ratio.

Accordingly, the present invention provides a diesel fuel composition having enhanced lubricity, said composition comprising a major amount of a diesel fuel as base fuel blended with a minor amount of a nitrogen rich fraction characterised in that the nitrogen rich fraction is derived from a source material selected from (i) a solvent extract of a solid or semi-solid natural fossil, or, (ii) a refinery process stream or blend, such that the sulphur to nitrogen atom ratio in said nitrogen rich fraction is less than 4.

The diesel fuel composition suitably has a sulphur content of less than 500 ppm by weight, preferably less than 150 ppm and more preferably less than 50 ppm by weight which is the so called ultra-low sulphur automotive diesel oil (hereafter "ULSADO"). The relatively low sulphur levels can be achieved in a number of ways. For instance, this may be achieved by well known methods such as catalytic hydrodesulphurisation. The lubricity properties of ultra-low sulphur (50 ppm or less) base fuels with a $T_{95}$ of suitably ≦370° C., preferably ≦360° C., particularly benefit from the presence of the nitrogen compounds referred to above. Especially, the lubricity properties are more of an issue with diesel fuels because diesel fuel injection pumps are more sensitive to wear problems. In particular, the rotary distribution diesel fuel injection pumps are solely lubricated by the fuel itself. These pumps contain precisely engineered components to maintain the consistency and precision of the injected fuel volume and to ensure a long service life. If the pump components become worn, irregular fuel injection may occur thereby leading to poor drivability, and increased emissions and may eventually lead to pump seizure.

The base fuels of the present invention may comprise mixtures of saturated and aromatic hydrocarbons and these can be derived from straight run streams, thermally or catalytically cracked hydrocarbon feedstocks, hydrocracked petroleum fractions, catalytically reformed hydrocarbons, or synthetically produced hydrocarbon mixtures. The present invention is particularly applicable to the automotive diesel oils, especially the so called ULSADO that have recently been introduced into the UK market (which may be sampled from Esso's Fawley Refinery).

The nitrogen-rich fraction can be derived from a source which is either a solid or a semi-solid fossil fuel by solvent extraction or a refinery process stream or fuel blend. These sources of nitrogen-rich fraction will hereafter be termed as "source materials" for convenience. The source comprising refinery process streams or fuel blends suitably distil within the diesel oil boiling range 150-450° C., preferably 150-400° C. and will jointly be referred to hereafter as "DOBR" for convenience. The DOBR in turn can originate directly from the pipestill or from secondary processing such as catalytic cracking of a heavy gas oil from the atmospheric or vacuum pipestill. Methods of processing petroleum crude to obtain various process streams are well known in the art and are described in detail for instance by Keith Owen and Trevor Colley in "Automotive Fuels Reference Book", Second Edition, published by the Society of Automotive Engineers, Inc. Warrendale, Pa.; USA (1995). Specifically, Chapter 3 of this-text-book at pages 29-49, Chapter 15 on Diesel Fuel Characteristic Influencing Combustion at pages 385-418, Chapter 18 at pages 519-522 relating to lubricity additives for diesel fuels, and Appendix 12 at pp 865-890 which is a 'Glossary of Terms' give all the information that is necessary to make and characterise such streams.

The nitrogen-rich fraction can be extracted from the source materials by a number of methods depending upon the nature of the source material. For instance where the source material is a natural solid or semi-solid fossil fuel such as eg coal, bitumen or oil shale, the nitrogen rich fraction is suitably recovered therefrom by a solvent extraction method such as eg using tetrahydrofuran or the like which preferentially extracts the nitrogen rich polar compounds therefrom. The solvent extraction may have to be repeated several times and the extracts concentrated to enrich the extract in nitrogen containing compounds. Where the source material is a DOBR, it preferably with a final boiling point at the upper end of this boiling range, ie 300-420° C., more preferably 350-400° C., where such nitrogen compounds tend to be concentrated. A nitrogen-rich fraction may be separated and recovered from DOBR by a method comprising:

a. using a stationary/liquid phase separation method in which the stationary phase is suitably selected from an absorbent like alumina, silica, silicic acid, clay and/or a zeolite, or b. a liquid/liquid phase separation based on the preferential partition of the components of the appropriate fractions between mutually immiscible solvents, or c. osmosis through a membrane.

Of these, the stationary/liquid phase separation method is preferable and the stationary phase is most preferably siliceous eg Biosil® (silicic acid). This method is readily implemented using column chromatography techniques. In some instances, it may be necessary to conduct a two- or multi-stage separation process in order to achieve the desired concentration of nitrogen in the fraction to render it to be suitable for blending with the diesel fuel.

When the nitrogen-rich fraction has been separated and recovered from DOBR, it is preferable to determine the sulphur to nitrogen ratio in such a nitrogen-rich fraction. It is necessary to do so in order to ensure that introduction of sulphur values into the diesel fuel are minimized thereby avoiding contravention of any environmental legislation. Thus, it is valuable to determine the suitability of the nitrogen-rich fraction for blending with diesel fuels and also to enable he most efficient use of the nitrogen values in the fraction. Thus, the desired fraction suitably has an absolute nitrogen content of at least 1000 ppm, preferably 2,000 ppm; a basic nitrogen content suitably of at least 200 ppm, preferably more than 400 ppm, eg 500 ppm; and a sulphur to nitrogen atom ratio of less than 4, preferably less than 1. Such a specification enables the nitrogen-rich fraction to be re-blended into the diesel fuel while still keeping the sulphur content within the desired specification.

Thus, the nitrogen-rich fraction so separated and recovered is suitably such that it contains at least 0.6% by weight (6,000 ppm) of nitrogen and is then re-blended into the diesel fuel. The amount of the nitrogen-rich fraction re-blended with the diesel fuel is suitably no more than about 1%, preferably 0.5% and most preferably 0.1% by weight of the total fuel composition.

By re-blending existing and naturally occurring nitrogen compounds in such fossil fuels, no extensive manufacturing or synthetic facilities need be set up to generate such lubricity enhancing compounds. Moreover, methods of separating, recovering and reblending such naturally occurring nitrogen compounds can be installed or retro-fitted at existing refinery and crude oil processing facilities without any substantial increase in production costs.

The antiwear and lubricity performance of the fuel compositions of the present invention were measured according to the so-called high frequency reciprocating rig test (hereafter referred to as "HFRR"). The HFRR test consists of a loaded upper ball 6 mm in diameter, which oscillates against a static lower plate. Both friction and contact resistance are monitored throughout the test. The tests are conducted according to the standard procedure published as CEC F-06-A-96 in which a load of 2N (200 g) was applied, the stroke length was 1 mm, the reciprocating frequency was 50 Hz and sample temperature of 60° C. The ambient temperature and humidity were controlled within the specified limits and the calculated value of wear scar diameter was corrected to the standardized water vapour pressure of 1.4 kPa. The specimen ball was a grade 28 (ANSIB3.12), AISI E-52100 steel with a Rockwell harness "C" scale (HRC) number of 58-66 (ISO 6508), and a surface finish of less than 0.05 μm $R_a$, and the lower plate was AISI E-52000 steel machined from anealed rod, with a Vickers hardness "HV30" scale number of 190-210 (ISO 6507/1). It is turned, lapped and polished to a surface finish of 0.02 μm $R_a$.

TABLE 1

Summary of HFRR test conditions

| | | | |
|---|---|---|---|
| Fluid volume, ml | 2.0 ± 0.20 | Specimen steel | AISI E-52100 |
| Fluid temperature, ° C. | 60 ± 2 | Ball diameter, mm | 6.00 |
| Bath surface area, $cm^2$ | 6.0 ± 1.0 | Surface finish (ball) | <0.05 μm Ra |
| Stroke length, mm | 1.0 ± 0.02 | Hardness (ball) | 58–66 Rockwell C |
| Frequency, Hz | 50 ± 1 | Surface finish (plate) | <0.02 μm Ra |
| Applied load, g | 200 ± 1 | Hardness (plate) | 190–210 HV 30 |

TABLE 1-continued

| Summary of HFRR test conditions | | | |
|---|---|---|---|
| Test duration, minutes | 75 ± 0.1 | Ambient conditions | See text |

The present invention is further illustrated with reference to the following Examples.

The source materials covered include a heavy catalytically cracked gas oil (CCGO) and a typical refinery fuel blend (Fawley blend). Isopar® M and a blend (67:33 by volume) of Isopar® M and mixed xylenes, available from most fine chemical suppliers, were used as base fuels to demonstrate the good lubricity performance of the nitrogen-rich fractions. Full details are shown in Table 2 below.

TABLE 2

| Analysis | Heavy CCGO | Fawley blend | Isopar ® M (typicals) |
|---|---|---|---|
| Paar Density (g/ml@15° C.) | — | 0.8503 | 0.7891 |
| KV 20 (cSt) | — | 4.85 | 2.72 |
| KV 40 (cSt) | — | 3.05 | 1.86 |
| Cloud Point (auto) (° C.) | — | −5 | — |
| CFPP (° C.) | — | −6 | — |
| Distillation (% at ° C.) | GCD* | D86 | D86 |
| IBP | — | 171 | 205 |
| 5 | 279 | 207 | 212 |
| 10 | 294 | 225 | 212 |
| 20 | — | 243 | 213 |
| 30 | — | 259 | 215 |
| 40 | — | 270 | 217 |
| 50 | 332 | 279 | 219 |
| 60 | — | 289 | 221 |
| 70 | — | 300 | 224 |
| 80 | — | 314 | 229 |
| 90 | 380 | 334 | 235 |
| 95 | 394 | 349 | 241 |
| FBP | — | 366 | 254 |
| Sulphur content | 1.7% | 1,180 ppm | 0 |
| Nitrogen content | 0.17% | 160 ppm | 0 |
| Basic Nitrogen (ppm) | 108 | — | 0 |
| IP 391 (mod)/RD/92/24 | | | |
| 1RAs | — | 20.73 | 0 |
| 2RAs | — | 9.14 | 0 |
| 3 + RAs | — | 2.11 | 0 |

*GCD (Gas chromatography Distillation) conducted according to ASTM D

The source materials were separated into fractions of increasing polarity by column chromatography. The majority of this was done using silica and Biosil® (silicic acid) stationary phases; however, a few others such as alumina and clay were also investigated. Details of the solvent elution systems used are given below:

1. Fractionation of Catalytically Cracked Gas Oil

The CCGO was fractionated by a two stage operation. In the first stage silica was employed as the stationary phase. The most polar fraction from this process was then fractionated further using silicic acid.

A. CCGO Fractionated on Silica 300 gms of the CCGO were blended with 200 gms of pentane and the resulting blend was run onto the column. The eluents were then added sequentially and the separate fractions collected as shown in Table 3 below.

TABLE 3

Silica fractionation of catalytically cracked gas oil

| Fraction | Eluent | Eluent volume (ml) | Wt collected (gm) |
|---|---|---|---|
| 1 | CCGO/n-$C_5$ | 300/200 | 135 |
| 2 | n-pentane | 200 | 108 |
| 3 | n-pentane | 200 | 23 |
| 4 | Tetrahydrofuran | 200 | 6 |
| 5 | Tetrahydrofuran | 400 | 29 |
| 6 | $CH_3Cl$/iPA/$NH_3$ (50:44:6) | 200 | <0.1 |
| 7 | MeOH/$NH_3$ | 300 | <0.1 |

iPA = isopropyl alcohol

B. Silica Fraction 5 (THF Fraction) Further Fractionated on Biosil

In this stage 20 gms of the Silica fraction 5 (Silica F5), from above, was added to 180 gms of silicic acid (Biosil) that had been treated 20 gms of water overnight. The solvent eluents were then added in sequence and the fractions collected separately as shown in Table 4 below.

TABLE 4

Fractionation of Silica fraction 5 on Biosil

| Fraction | Eluent | Eluent volume (ml) | Wt collected (gm) |
|---|---|---|---|
| 1 | n-hexane | 250 | 0.02 |
| 2 | n-hexane/dichloromethane (94:4) | 500 | 11.92 |
| 3 | n-hexane/dichloromethane (50:50) | 500 | 4.88 |
| 4 | Dichloromethane/methanol (50:50) | 300 | 0.66 |
| 5 | CHCl3/iPA/NH3 (50:40:10) | 300 | 0.58 |

iPA = isopropyl alcohol

It was found that non-polar compounds do not interact with the stationary phase and thus pass through the column quicker than polar compounds. Solvent eluents with increasing polarity were sequentially passed through the column to assist the removal of compounds with increasing the polarity. The more polar fractions were used to investigate boundary lubrication effects using the HFRR technique outlined above.

Compositional analysis data for the resultant fractions are shown in Table 5 and treat rates used and the HFRR results achieved are shown in Table 6 below:

TABLE 5

Composition and performance of fractions from catalytically cracked stream

| Fraction | N (ppm) | N basic (ppm) | S (ppm) | S/N ratio |
|---|---|---|---|---|
| CCGO | 1,700 | 108 | 17,000 | 10 |
| Silica F 5 | 19,000 | — | 14,000 | 0.7 |
| Biosil ® fraction 2 | 0 | 0 | 21,000 | — |
| Biosil ® fraction 3 | 30,000 | 500 | 4,000 | 0.1 |
| Biosil ® fraction 4 | 6,000 | 4,300 | 0 | 0.0 |
| Biosil ® fraction 5 | 35,000 | 31,700 | 21,000 | 0.6 |

10,000 ppm = 1%
— = data not available

There was an insufficient amount of biosil fraction 1 to conduct any compositional analysis or HFRR evaluation.

TABLE 6

Lubricity performance of fractions from cracked gas oil

| Fraction | HFRR Wear Scar Diameter (μm) at specified Treat rates | | | | |
|---|---|---|---|---|---|
| | 0 | 1% | 3% | 4.5% | 6.0% |
| Silica F5 | 741 | — | 488 | 351 | 371 |
| BF2 | " | — | 776 | 756 | 753 |
| BF3 | " | 737 | 403 | 313 | |
| BF4 | " | 391 | 321 | — | — |
| BF5 | " | 359 | 295 | — | — |

Fractions blended into a mixture of Isopar ® M and mixed xylenes (67:33 by volume) at concentrations shown in above Table.
BF = Biosil ® fraction
— = data not available The silica polar fraction (fraction 5) and the latter Biosil fractions 3 to 5 boosted the lubricity performance to an improved level (smaller wear scar diameter). These fractions have high N content (>0.6%, 6,000 ppm), a basic nitrogen content of 500 ppm or more and have an improved S/N ratio (0.1 vs 10) when compared with the original sample prior to fractionation. Thus, the improved lubricity performance is achieved with a smaller amount of added fraction and with a smaller increase in S content.

2. Fractionation of Fawley Fuel Blend

This fuel blend was fractionated using silica and clay as the stationary phase.

A. Fawley Fuel Blend Fractionated on Silica 300 gms of the fuel blend was run onto the column, and following this the eluents were added sequentially and the separate fractions collected as shown in Table 7 below.

TABLE 7

Silica fractionation of Fawley fuel blend

| | Eluent | Eluent volume (ml) | Wt collected (gm) |
|---|---|---|---|
| 1 | No eluent (only fuel blend added) | 300 gms | 135 |
| 2 | n-pentane | 200 | 108 |
| 3 | n-pentane | 200 | 23 |
| 4 | Tetrahydrofuran | 200 | 6 |
| 5 | Tetrahydrofuran | 200 | 29 |

B. Fawley Fuel Blend Fractionated on Clay 300 gms of the fuel blend was run onto the column, and following this the eluents were added sequentially and the separate fractions collected as shown in Table 8 below.

TABLE 8

Clay fractionation of Fawley fuel blend

| | Eluent | Eluent volume (ml) | Wt collected (gm) |
|---|---|---|---|
| 1 | No eluent (only fuel blend added) | 300 gms | 124 |
| 2 | n-pentane | 200 | 123 |
| 3 | n-pentane | 200 | 48 |
| 4 | Tetrahydrofuran | 400 | 4 |

Compositional analysis data for the starting blend and key fractions are shown in Table 9 and treat rates used and the HFRR results achieved for the silica and clay polar fractions are shown in Table 10 below:

TABLE 9

Composition of fractions from Fawley fuel blend

| Fraction | N (ppm) | N basic (ppm) | S (ppm) | S/N ratio |
|---|---|---|---|---|
| Blend | 160 | — | 1,180 | 7.4 |
| Silica F 5 | 2,100 | — | 8,200 | 3.9 |
| Clay fraction 4 | 5,200 | — | 4,500 | 0.9 |
| BF1 | 0 | — | 6,250 | — |
| BF2 | 100 | — | 7,600 | 76.0 |
| BF3 | 35,000 | — | 5,900 | 0.2 |
| BF4 | 20,000 | — | 23,500 | 1.2 |

BF = Biosil Fraction,
10,000 ppm = 1%

TABLE 10

Lubricity Performance of Silica F5 and Clay Fraction 4

| Concn in Isopar M(%) | Silica F5 | Clay F5 |
|---|---|---|
| 0 | 633 | 633 |
| 2 | 672 | 679 |
| 4 | 627 | 289 |
| 6 | 385 | 243 |
| 8 | 252 | 249 |

Fractions blended into a Isopar ® M at concentrations shown in above Table.

These data show that both fractions had a beneficial effect on the lubricity performance of Isopar M, with the clay fraction being more potent than the Silica fraction.

The invention claimed is:

1. A method for producing a diesel fuel composition having enhanced lubricity, said method comprising combining a major amount of a diesel fuel as base fuel with up to 8 weight % of a nitrogen rich fraction said nitrogen rich fraction being separated and recovered from oils and fossil fuels selected from the group consisting of refinery process stream or fuel blend which refinery process stream or fuel blend distill within a diesel oil boiling range of 150-400° C. and such that the sulphur to nitrogen atom ratio in said nitrogen rich fraction is less than 4, said nitrogen rich fraction being separated and recovered from said refinery process stream or fuel blend by (a) using a stationary/liquid phase separation method in which the stationary phase is an absorbent, or (b) a liquid/liquid phase separation based on the preferential partition of the components of the appropriate fractions between mutually immiscible solvents, or (c) osmosis through a membrane.

2. The method according to claim 1 wherein the refinery process stream or fuel blend is sourced from a pipestill or from a secondary processing of a stream comprising catalytic cracking of a heavy gas oil in turn derived from an atmospheric or vacuum pipestill.

3. The method according to claim 1 wherein the absorbent in the stationary phase is selected from alumina, silica, silicic acid, clay and/or a zeolite.

4. The method according to claim 1 or 2 wherein the nitrogen rich fraction has an absolute nitrogen content of at least 1000 ppm by weight.

5. The method according to claim 1 or 2 wherein the nitrogen rich fraction has an absolute nitrogen content of at least 1000 ppm by weight, and a basic nitrogen content of at least 200 ppm by weight.

6. The method according to claim 1 or 2 wherein said nitrogen rich fraction has an absolute nitrogen content of at least 6000 ppm by weight.

7. The method according to claim 6 wherein the nitrogen rich fraction has a sulphur to nitrogen atom ratio of less than 1.

8. The method according to claim 1 or 2 wherein the amount of the nitrogen-rich fraction in the base fuel is no more than 1% by weight of the total fuel composition.

9. The method according to claim 1 or 2 wherein the base fuel contains up to 50 ppm of sulphur and has a $T_{95}$<370° C.

* * * * *